US005694735A

United States Patent [19]

Lovas

[11] Patent Number: 5,694,735

[45] Date of Patent: Dec. 9, 1997

[54] METHOD AND A TOOL FOR CRIMPING A TEE OR MAIN

[76] Inventor: Gary Lovas, 3431 Woodland Dr., Murrysville, Pa. 15668

[21] Appl. No.: 574,723

[22] Filed: Dec. 19, 1995

[51] Int. Cl.[6] ..... E04B 9/30

[52] U.S. Cl. ..... 52/745.19; 52/506.07; 52/733.1; 52/745.05; 52/745.2; 29/401.1; 72/461

[58] Field of Search ..... 52/733.1, 745.05, 52/745.06, 745.13, 745.19, 75.2, 747.11, 506.07; 72/458, 457, 461, 479; 29/401.1, 509, 897.3

[56] References Cited

U.S. PATENT DOCUMENTS

| | | | |
|---|---|---|---|
| Re. 31,528 | 3/1984 | Mieyal | 52/506.07 X |
| 3,977,144 | 8/1976 | Jahn | 52/745.13 X |
| 5,042,286 | 8/1991 | Wiebe et al. | 72/461 X |

FOREIGN PATENT DOCUMENTS

| | | | |
|---|---|---|---|
| 580994 | 10/1976 | Switzerland | 72/461 |

*Primary Examiner*—Carl D. Friedman
*Assistant Examiner*—Timothy B. Kang
*Attorney, Agent, or Firm*—Arnold B. Silverman; Eckert Seamans Cherin & Mellott

[57] ABSTRACT

The present invention pertains to a method of forming a ceiling. The method comprises the steps of setting a tool for a desired length of crimp of a tee or main by adjusting a plate in a slot of the tool, Next there is the step of cutting the tee or main to a desired length. Then there is the step of inserting an end of tee or main into a slot in the tool to a desired length. Next there is the step of crimping tee or main about 90° with the tool without removing any length from the tee or main. Then there is the step of removing the tool from the tee or main. The present invention also pertains to a tool to crimp a tee or main. The tool comprises a housing having an end, with a first slot disposed in the end. Additionally, the tool comprises a plate disposed in the first slot of the housing. The plate is adjustable in regard to position in the first slot so the tee or main can be inserted into the first slot a desired distance defined by where the plate is disposed in the first slot.

5 Claims, 4 Drawing Sheets

METHOD AND A TOOL FOR CRIMPING A TEE OR MAIN

FIELD OF THE INVENTION

The present invention is related to a tool for construction. More specifically, the present invention is related to a tool and a method of its use for crimping a tee.

BACKGROUND OF THE INVENTION

In installing prior art revealed edge ceiling tile with ¼ inch reveal, there has been the problem of needing to install the ceiling tiles, mains, and wall mold at the exact same height. Such installation generally involved measuring the area for the length of tile to be installed, cutting the tile to this desired length, installing the tile, marking or scribing the tile along the edge of the wall mold, removing the tile, and cutting along the scribe so that the finished tile will have a inch revealed edge along the wall mold and re-installing the ceiling tile.

SUMMARY OF THE INVENTION

The system of the present invention has solved the above-described problem in installing revealed edge ceiling tile with ¼ inch reveal. The ceiling tees and mains will be installed ¼ inch above the height of the wall mold. The tees and mains which will be resting on the wall mold will be crimped ¼ inch using the tool of the present invention. One then measures the area for the length of tile to be installed, cuts the tile to this desired length, and installs the tile.

Using the tool of the present invention will save much time by eliminating the need to cut the revealed edge in along the wall mold. Also, this cut is usually very brittle and if not done perfectly, becomes very noticeable of a poor job. Other trades who need access above the ceiling after the tile is in place usually damage this brittle revealed edge resulting in replacing the entire ceiling tile and repeating all seven steps described above. The inventive tool will leave a clean finish along the wall mold and make it very easy for other trades to remove and reinstall the tile without any damage to the tile.

The present invention pertains to a method of forming a ceiling. The method comprises the steps of setting a tool for a desired length of crimp of a tee or main by adjusting a plate in a slot of the tool. Subsequently, one cuts the tee or main to a desired length. Next the portion of the tee or main to be crimped are inserted into the slot in the tool to the desired length of crimp. Subsequently, there is crimping tee or main about 90° from its original orientation with the tool without taking any length from the tee or main. Next, one separates the tool from the tee or main.

The present invention also pertains to a tool to crimp a tee or main. The tool comprises a housing having an end, with a first slot disposed in the end. Additionally, the tool comprises a plate disposed in the first slot of the housing. The plate is adjustable in regard to position in the first slot so the tee or main can be inserted into the first slot a desired distance defined by where the plate is disposed in the first slot.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

The terms "tee" and "main " as used herein shall have the ordinary meaning employed in connection with ceiling constructions of the type toward which the invention is directed.

Figure 1:
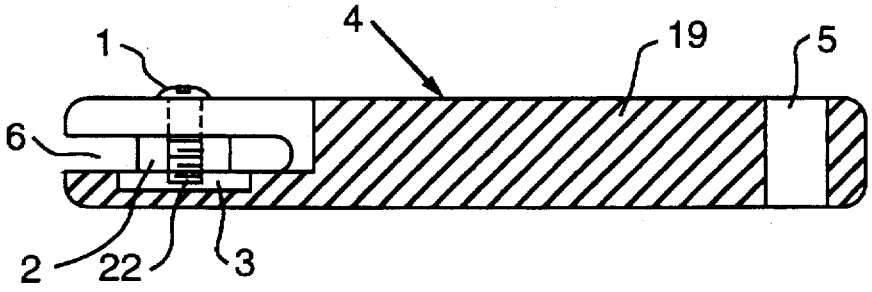
FIG. 1 is a side view of a tool of the present invention.
Figure 2:
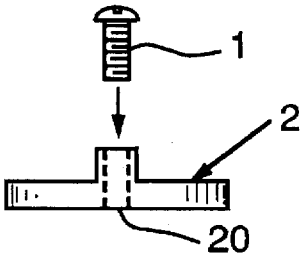
FIG. 2 is an exploded front view a plate and screw of the present invention.
Figure 3:
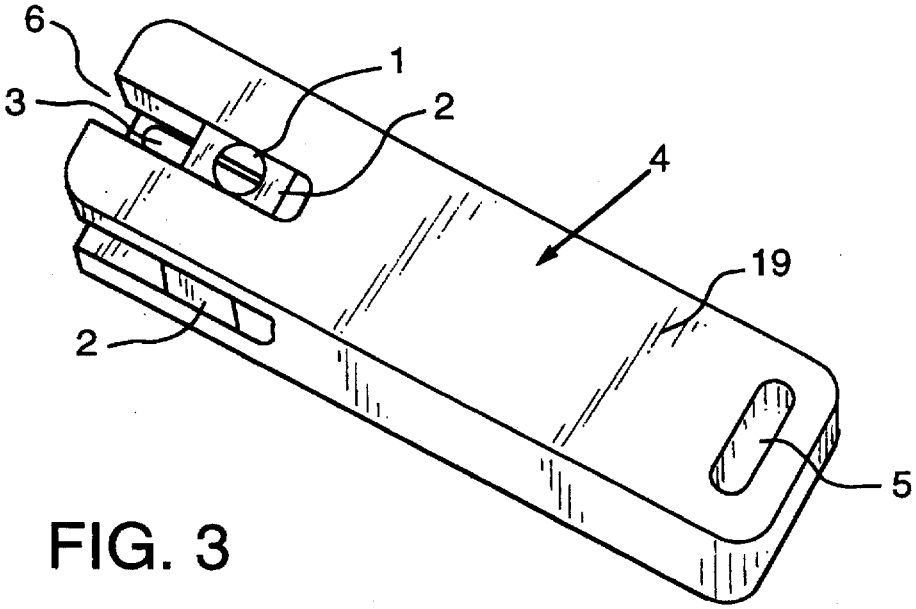
FIG. 3 is a perspective view type showing the top, one side and one end of a tool of the present invention.

Referring now to the drawings wherein like reference numerals refer to similar or identical parts throughout the several views, and more specifically to FIGS. 1–3 thereof, there is shown a small hand tool 4 to be used by suspended ceiling grid installers when revealed edge ceiling tile is used. Most commonly, the thickness of the revealed edge of the tile ranges between 3/16 of an inch to ½ inch. This tool 4 is adjustable to accommodate to these and between these dimensions i.e., 3/16 of an inch to ½ inch. The purpose of this tool 4 is to put a crimp 17 in the end of the tee 16 or main which will raise the tee 16 or main above the wall the height of the thickness of the revealed edge of the ceiling tile to be installed. This crimp 17 will allow the finished surface of the ceiling tile to rest firmly on the wall mold 18 while the edge of the ceiling tile rests firmly on the tees 16 and main.

As shown in FIGS. 1–3, a bolt 1 is threadedly received within internally threaded bore 20 of plate 2 with the free end 22 of the bolt extending into elongated slot 3 formed within the body of tool 4. This serves to define a slot 6 within which the end of the tee or main to be crimped may be inserted. An opening 5 is provided through the end of the elongated body 19.

Figure 4:
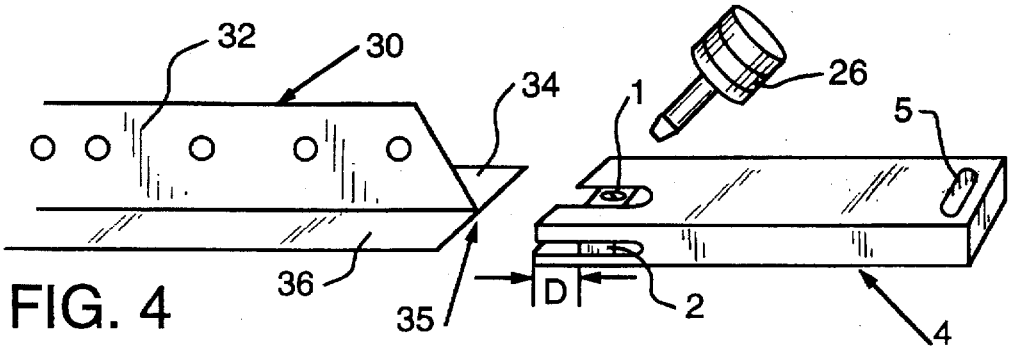
FIG. 4 is a schematic perspective view of the tool of the present invention being applied to a tee and an associated screwdriver.

Referring to FIGS. 4–7, there is shown the tool 4 and a screwdriver 26 adapted to rotate bolt 1. As shown in FIG. 4, the aligned tee or main 30 has an upstanding fin 32 and a horizontal portion 35 which has a pair of horizontal webs 34, 36 on opposite sides of fin 32 and which will enter the slot 6 of the tool 4.

Figure 5:
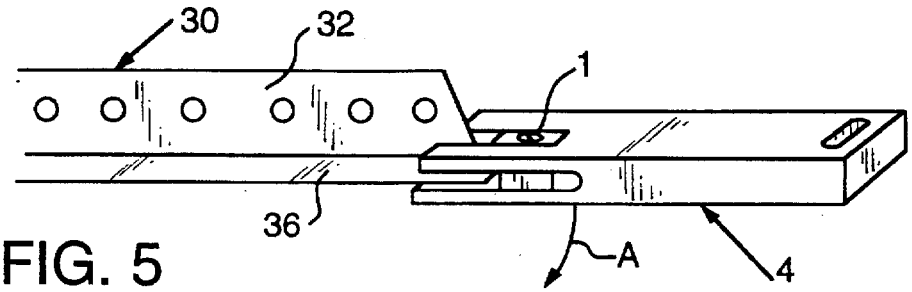
FIG. 5 is a schematic perspective view of the tool with the tee in the first slot.
Figure 6:
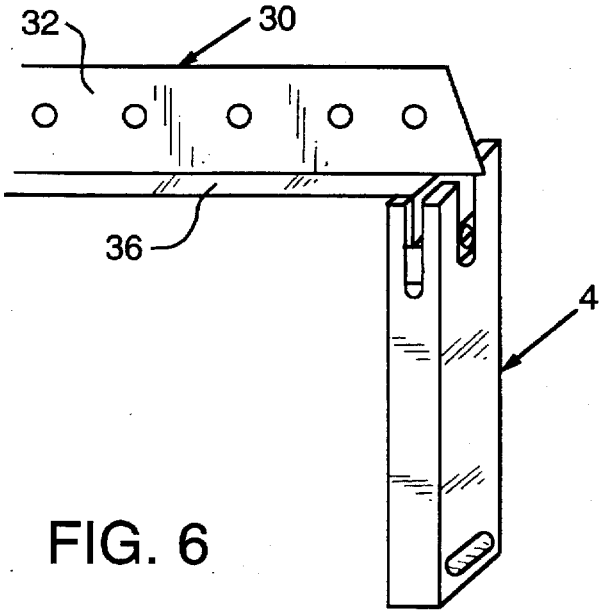
FIG. 6 is a schematic perspective view of the tool after crimping the horizontal portions of tee.
Figure 7:
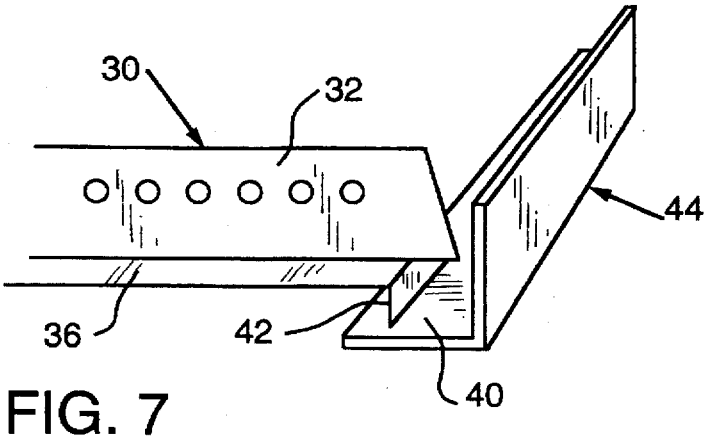
FIG. 7 is a schematic perspective view of the tee on a wall mold.

Referring still to FIGS. 4 through 6, it will be appreciated that the plate 2 is set to establish the desired depth of slot D, after which screwdriver 26 is employed to tighten the bolt 1. After that, horizontal webs 34, 36 of the tee 30 is inserted into slot 6 (FIG. 5) and the tool is rotated approximately 90° as indicated by arrow A to assume the position shown in FIG. 6 which means that the end portions of horizontal segments 34, 36 have been bent about 90° with respect to the original position. The tool 4 is then removed from the crimped or bent end and the crimped portion 40 is positioned on the horizontal leg 42 of wall mold 44 to achieve the desired spacing as shown in FIG. 7.

Figure 8:
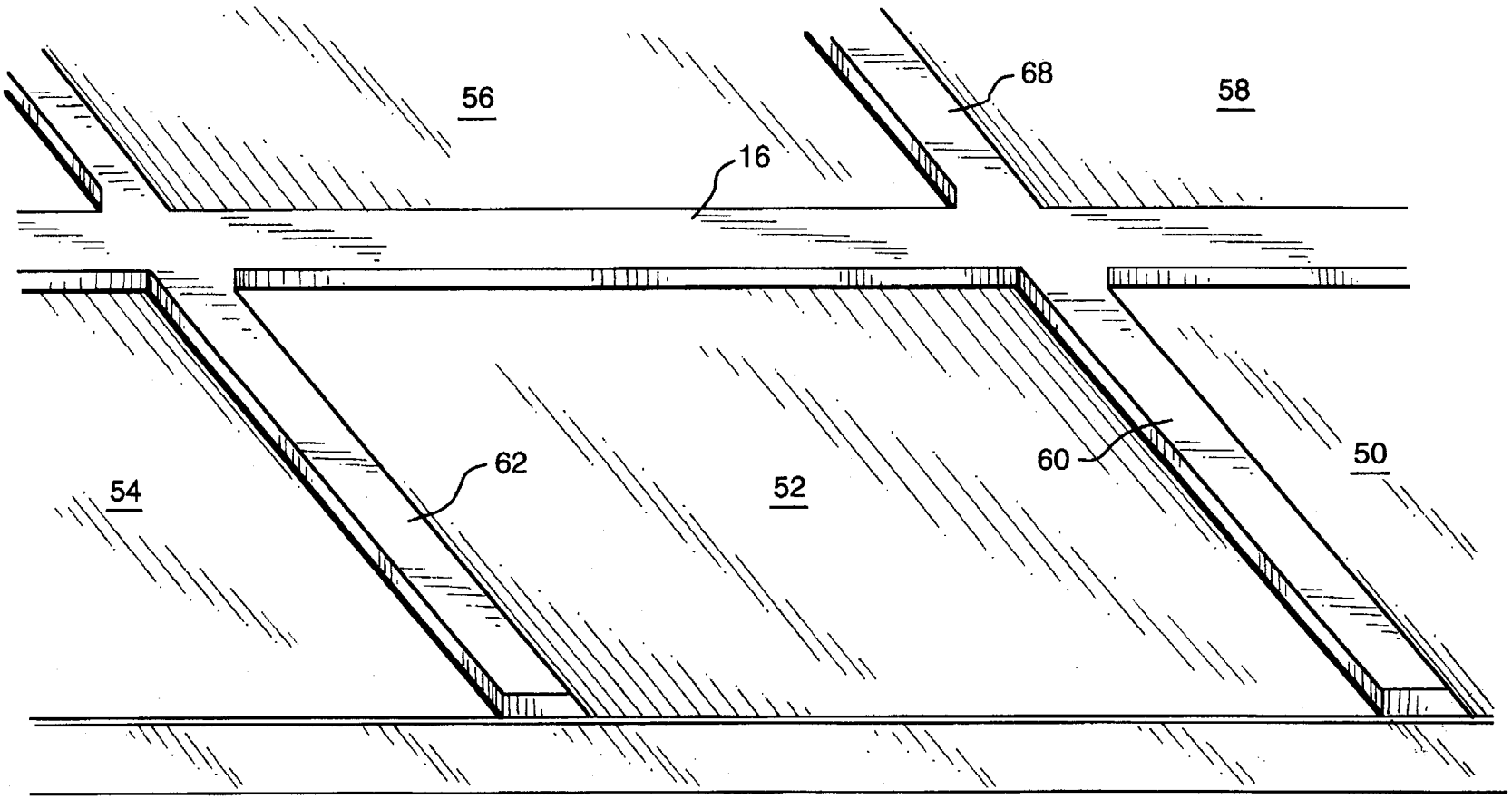
FIG. 8 is a schematic perspective view of a ceiling portion of a with tees and tile.
Figure 9B:
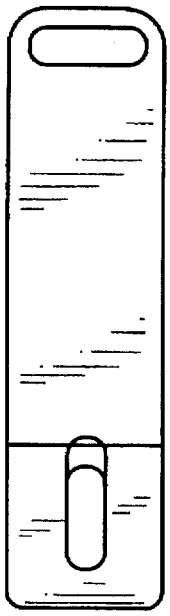
FIG. 9B is a top plan view of a body portion of the tool of the present invention.
Figure 9E:
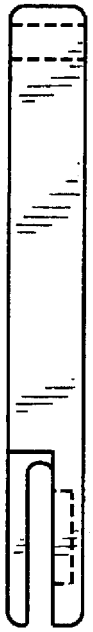
FIG. 9E is a front elevational view of the body portion of the tool.
Figure 9A:
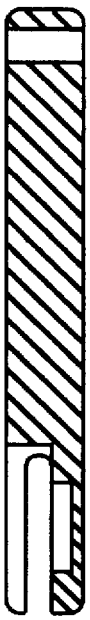
FIG. 9A is a longitudinal cross-sectional view of a portion of the body of a tool of the present invention.
Figure 9D:
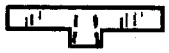
FIG. 9D is a right side elevational view of the plate of FIG. 9C.
Figure 9C:
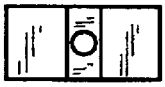
FIG. 9C is a top plan view of a plate which combines with the body portion of the tool to establish the desired slot for entry of a tee or main portion to be crimped.

The result is a ceiling with tiles 50, 52, 54, 56, 58 and tees 16, 60, 62 on wall molds 18, as shown in FIG. 8. FIGS. 9A–9E show details of a preferred embodiment of the present invention.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method of forming a ceiling having a plurality of ceiling tiles comprising the steps of:

setting a tool for a desired length of crimp of a tee or main by adjusting a plate in a slot in the tool to establish a desired slot depth;

cutting a tee or main to a desired length;

inserting an end of said tee or main into said slot;

crimping a tee or main with said tool about 90° from its original position without reducing the overall length from the tee or main;

separating the tool from the tee or main;

placing said tee or main in ceiling tile supporting position, repeating said process until the desired ceiling tile supporting structure is established, and positioning the ceiling tiles on said ceiling tile supporting structure.

2. A method as described in claim 1 including securing wail molds to walls adjacent to where said ceiling will be formed, and effecting said placing by placing an end of the tee or main on a wall mold.

3. A method as described in claim 2 including after establishing said ceiling tile supporting structure, positioning said ceiling tile generally horizontally on said ceiling tile supporting structure without cutting the tile.

4. The method of claim 1 including providing said tees and mains prior to crimping with a generally horizontal base and a generally vertical fin projecting upwardly therefrom, and effecting said crimping on an end of said generally horizontal base.

5. The method of claim 1 including establishing said slot depth at about 3/16 to ½ inch.

* * * * *

UNITED STATES PATENT AND TRADEMARK OFFICE

CERTIFICATE OF CORRECTION

PATENT NO. : 5,694,735

DATED : December 9, 1997

INVENTOR(S) : Gary Lovas

It is certified that error appears in the above-identified patent and that said Letters Patent is hereby corrected as shown below:

Column 1, line 18, before "inch" insert -- a ¼--.

Column 1, line 45, change "portion" to -- portions --.

Column 1, line 66, after "view" insert -- of --.

Column 2, line 1, delete (type) between "view" and "showing".

Column 2, lines 13-14, after "view of a" delete (ceiling), after "portion of a" insert -- ceiling --.

Column 4, line 9, change "wail" to -- wall --.

Signed and Sealed this

Twenty-first Day of December, 1999

*Attest:*

*Attesting Officer*

Q. TODD DICKINSON

*Acting Commissioner of Patents and Trademarks*